US009366427B2

(12) United States Patent
Sonnichsen et al.

(10) Patent No.: US 9,366,427 B2
(45) Date of Patent: Jun. 14, 2016

(54) SOLID FUEL BURNER WITH ELECTRODYNAMIC HOMOGENIZATION

(71) Applicant: ClearSign Combustion Corporation, Seattle, WA (US)

(72) Inventors: Tim W. Sonnichsen, Snoqualmie, WA (US); Joseph Colannino, Bellevue, WA (US); David B. Goodson, Bellevue, WA (US); Tracy A. Prevo, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 571 days.

(21) Appl. No.: 13/850,936

(22) Filed: Mar. 26, 2013

(65) Prior Publication Data

US 2013/0255549 A1 Oct. 3, 2013

Related U.S. Application Data

(60) Provisional application No. 61/640,695, filed on Apr. 30, 2012, provisional application No. 61/616,223, filed on Mar. 27, 2012.

(51) Int. Cl.

| | |
|---|---|
| ***F23C 99/00*** | (2006.01) |
| ***F23K 3/18*** | (2006.01) |
| ***F23B 60/02*** | (2006.01) |
| ***F23G 5/50*** | (2006.01) |
| ***F23B 90/00*** | (2011.01) |

(Continued)

(52) U.S. Cl.

CPC ..... *F23C 99/001* (2013.01); *F23B 7/00* (2013.01); *F23B 60/02* (2013.01); *F23B 90/00* (2013.01); *F23G 5/50* (2013.01); *F23K 3/18* (2013.01); *F23B 2900/00006* (2013.01); *F23G 7/10* (2013.01); *F23G 7/12* (2013.01)

(58) Field of Classification Search

CPC ..... F23C 99/001

See application file for complete search history.

(56) References Cited

U.S. PATENT DOCUMENTS

| | | | |
|---|---|---|---|
| 1,153,182 | A | 9/1915 | Schniewind |
| 2,604,936 | A | 7/1952 | Kaehni et al. |

(Continued)

FOREIGN PATENT DOCUMENTS

| | | |
|---|---|---|
| WO | WO 96/01394 | 1/1996 |

OTHER PUBLICATIONS

Altendrfner et al., "Electric Field Effects on Emissions and Flame Stability With Optimized Electric Field Geometry", Third European Combustion Meeting ECM 2007, p. 1-6.

(Continued)

*Primary Examiner* — David J Laux

(74) *Attorney, Agent, or Firm* — Christopher A. Wiklof; Nicholas S. Bromer; Launchpad IP, Inc.

(57) ABSTRACT

A solid fuel burner may include a system for electrodynamic homogenization. One or more electrodes may apply an electric field to burning solid fuel or a region proximate the burning solid fuel. The electric field causes mixing and homogenization of volatilized fractions of the solid fuel, combustion gases, and air. The improved mixing and homogenization may reduce emission of carbon monoxide (CO), reduce emission of oxides of nitrogen (NOx), reduce oxygen in flue gas, increase temperature of flue gas, and/or allow for a larger grate surface.

58 Claims, 6 Drawing Sheets

(51) Int. Cl.

| | |
|---|---|
| ***F23B 30/00*** | (2006.01) |
| *F23G 7/10* | (2006.01) |
| *F23G 7/12* | (2006.01) |

(56) References Cited

U.S. PATENT DOCUMENTS

| | | | | |
|---|---|---|---|---|
| 3,087,472 | A | 4/1963 | Asakawa | |
| 3,224,485 | A | 12/1965 | Blomgren et al. | |
| 3,306,338 | A | 2/1967 | Wright et al. | |
| 3,358,731 | A | 12/1967 | Donnelly | |
| 3,416,870 | A | 12/1968 | Wright | |
| 3,503,348 | A | 3/1970 | Dvirka | |
| 3,749,545 | A | 7/1973 | Velkoff | |
| 3,841,824 | A | 10/1974 | Bethel | |
| 3,869,362 | A | 3/1975 | Machi et al. | |
| 4,052,139 | A | 10/1977 | Paillaud et al. | |
| 4,091,779 | A | 5/1978 | Saufferer et al. | |
| 4,093,430 | A | 6/1978 | Schwab et al. | |
| 4,110,086 | A | 8/1978 | Schwab et al. | |
| 4,111,636 | A | 9/1978 | Goldberg | |
| 4,118,202 | A | 10/1978 | Scholes | |
| 4,219,001 | A | 8/1980 | Kumagai et al. | |
| 4,260,394 | A | 4/1981 | Rich | |
| 4,304,096 | A | 12/1981 | Liu et al. | |
| 4,340,024 | A | 7/1982 | Suzuki et al. | |
| 4,439,980 | A | 4/1984 | Biblarz et al. | |
| 4,576,029 | A | 3/1986 | Miyake et al. | |
| 4,649,260 | A | 3/1987 | Melis et al. | |
| 4,675,029 | A | 6/1987 | Norman et al. | |
| 4,903,616 | A | 2/1990 | Mavroudis | |
| 4,987,839 | A | 1/1991 | Krigmont et al. | |
| 5,702,244 | A * | 12/1997 | Goodson | F01N 3/01 126/500 |
| 6,640,549 | B1 | 11/2003 | Wilson et al. | |
| 6,736,133 | B2 | 5/2004 | Bachinski et al. | |
| 6,742,340 | B2 | 6/2004 | Nearhoof, Sr. et al. | |
| 6,918,755 | B1 | 7/2005 | Johnson et al. | |
| 7,137,808 | B2 | 11/2006 | Branston et al. | |
| 7,168,427 | B2 | 1/2007 | Bachinski et al. | |
| 7,182,805 | B2 | 2/2007 | Reaves | |
| 7,226,496 | B2 | 6/2007 | Ehlers | |
| 7,226,497 | B2 | 6/2007 | Ashworth | |
| 7,243,496 | B2 | 7/2007 | Pavlik et al. | |
| 7,377,114 | B1 | 5/2008 | Pearce | |
| 7,523,603 | B2 | 4/2009 | Hagen et al. | |
| 7,845,937 | B2 | 12/2010 | Hammer et al. | |
| 8,082,725 | B2 | 12/2011 | Younsi et al. | |
| 8,245,951 | B2 | 8/2012 | Fink et al. | |
| 9,151,549 | B2 | 10/2015 | Goodson et al. | |
| 2004/0185397 | A1 * | 9/2004 | Branston | F23C 99/001 431/2 |
| 2005/0208442 | A1 | 9/2005 | Heiligers et al. | |
| 2007/0020567 | A1 * | 1/2007 | Branston | F02M 27/04 431/8 |
| 2010/0183424 | A1 | 7/2010 | Roy | |
| 2011/0027734 | A1 * | 2/2011 | Hartwick | F23C 99/001 431/264 |
| 2011/0203771 | A1 | 8/2011 | Goodson et al. | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 * | 10/2013 | Goodson | F23G 5/442 110/342 |
| 2013/0255549 | A1 | 10/2013 | Sonnichsen et al. | |
| 2013/0260321 | A1 | 10/2013 | Colannino et al. | |
| 2014/0208758 | A1 | 7/2014 | Breidenthal et al. | |
| 2014/0338350 | A1 | 11/2014 | Breidenthal | |

OTHER PUBLICATIONS

William T. Brande; "The Bakerian Lecture: On Some New Electro-Chemical Phenomena", Phil. Trans. R. Soc. Lond. 1814 104, p. 51-61.

James Lawton and Felix J. Weinberg. "Electrical Aspects of Combustion". Clarendon Press, Oxford. 1969.

James Lawton et al., Electrical Aspects of Combustion, 1969, p. 81, Clarendon Press, Oxford, England.

* cited by examiner

PRIOR ART

SOLID FUEL BURNER WITH ELECTRODYNAMIC HOMOGENIZATION

CROSS-REFERENCE TO RELATED APPLICATIONS

The present application claims priority benefit from U.S. Provisional Patent Application No. 61/640,695, entitled "SOLID FUEL BURNER WITH ELECTRODYNAMIC HOMOGENIZATION", filed Apr. 30, 2012; and from U.S. Provisional Patent Application No. 61/616,223, entitled "MULTIPLE FUEL COMBUSTION SYSTEM AND METHOD", filed Mar. 27, 2012; which, to the extent not inconsistent with the disclosure herein, are incorporated by reference.

BACKGROUND

FIG. 1 is a diagram illustrating a portion of a grate-fed solid fuel burner 101 according to the prior art and which is improved according to the disclosure herein. A solid fuel burner may include walls 102 defining a combustion volume and a grate 104 on which solid fuel 106 is supported. Underfire combustion air may be delivered to the fuel from below the grate 104 via an underfire or primary air source 108 from an air blower 110. Hot gas 112 may then be delivered to generate electricity (e.g., by heating water tubes for delivery of steam to a steam turbine), to heat air (e.g., by transferring energy through an air-air heat exchanger), or for heating a process material. The fuel 106 may include various solid fuels such as lump coal (e.g. anthracite, bituminous coal, and/or lignite), biomass fuel, tire-derived fuel (TDF), municipal solid waste (MSW), refuse derived fuel (RDF), hazardous solid waste, etc.

Solid fuel burners are notorious for non-ideal flow behavior such as clumping. Fuel clumping has been associated with variable resistance to undergrate air flow. Fuel clumping may be visualized as a formation of "hills" 114 and "valleys" 116 in fuel 106 on the grate 104. The hills 114 typically have high resistance to airflow, and the valleys 116 typically have low resistance to airflow. Additionally, airflow may be affected by proximity to the walls 102. A result of this variable resistance to airflow is that there may be less airflow than desirable in regions 118 above the hills 114, and more airflow than desirable in regions 120 above the valleys 116. Moreover, the solid fuel 106 typically volatilizes responsive to high temperatures from combustion, and it is the volatilized, gas phase components that actually burn. There may be more volatilization above the hills 114 than the valleys 116, which may further add to the disparity in composition between the regions 118 above the hills 114 and the regions 120 above the valleys.

The non-homogeneity of the regions 118, 120 leads to two undesirable conditions. Regions 118 with low airflow tend not to have enough oxygen for complete combustion. This results in cooler temperatures and high output of carbon monoxide (CO) and other products of incomplete combustion. Conversely, excess airflow in the regions 120 causes high temperatures and relatively high concentrations of oxygen and nitrogen, both of which tend to cause formation of oxides of nitrogen (NOx).

Manufacturers and operators of solid fuel burners 101 have attempted to ameliorate the problems associated with non-homogeneity by introducing overfire or secondary air above the grate 104 and the fuel 106 with one or more overfire air sources 122. The overfire air is typically introduced at high velocity to help mixing of the regions 118, 120. Unfortunately, while overfire air may provide more oxygen to complete combustion of CO to carbon dioxide ($CO_2$), it may not affect or can even make more severe the formation of NOx. Moreover, it is typical that overfire air is added in excess. Excess overfire air reduces the temperature of flue gases 112 and can reduce thermodynamic efficiency of processes driven by the heat produced by combustion. Reduced thermodynamic efficiency may generally require burning more fuel to create a desired output, or may reduce the amount of the output for a given amount of fuel. Finally, the ability to deliver overfire air across a wide grate 104 is limited by the amount of inertia that can be imparted on the overfire air and the distance it can travel through buoyant forces associated with the combustion.

What is needed is a technology that can improve uniformity or homogeneity of reactive gases associated with a solid fuel burner. It is also desirable to improve gas homogeneity with minimum cooling of exit gas temperature. Finally, some applications by benefiting from improved homogeneity across a grate having dimensions larger than what may be addressed by overfire air.

SUMMARY

According to an embodiment, a solid fuel burner may be provided with a system for providing electrodynamic homogenization. The solid fuel burner may include a grate configured to support a burning solid fuel and an underfire air source configured to deliver underfire air to the burning solid fuel from below the grate. The system for providing electrodynamic homogenization may include an electrode (one or more electrodes) configured to apply an electric field to the burning solid fuel or a region proximate the burning solid fuel. The electric field, which may include a time-varying electric field, may be selected to cause mixing and homogenization of volatilized fractions of the solid fuel, combustion gases, and air. The improved mixing and homogenization may result in reduced emission of carbon monoxide (CO), reduced emission of oxides of nitrogen (NOx), reduced oxygen in flue gas, increased temperature of flue gas, and/or allow for a larger grate surface.

According to an embodiment, a solid fuel burner may include a system for providing electrodynamic homogenization. The system may include a grate configured to support a burning solid fuel and an underfire air source configured to deliver underfire air to the burning solid fuel from below the grate. An electrode (one or more electrodes) may be configured to apply an electric field to the burning solid fuel or a region proximate the burning solid fuel. The electric field, which may include a time-varying electric field, may be selected to cause mixing and homogenization of volatilized fractions of the solid fuel, combustion gases, and air. The improved mixing and homogenization may result in reduced emission of carbon monoxide (CO), reduced emission of oxides of nitrogen (NOx), reduced oxygen in flue gas, increased temperature of flue gas, and/or allow for a larger grate surface.

According to another embodiment, a method for operating a solid fuel burner may include delivering underfire combustion air below a grate, burning solid fuel on the grate with the combustion air in a combustion reaction, and homogenizing a mixture of volatilized solid fuel and underfire combustion air in the combustion reaction by applying an electric field with at least one electrode disposed above the grate or comprising the grate. The electric field may include a time-varying electric field.

DETAILED DESCRIPTION

Figure 1:
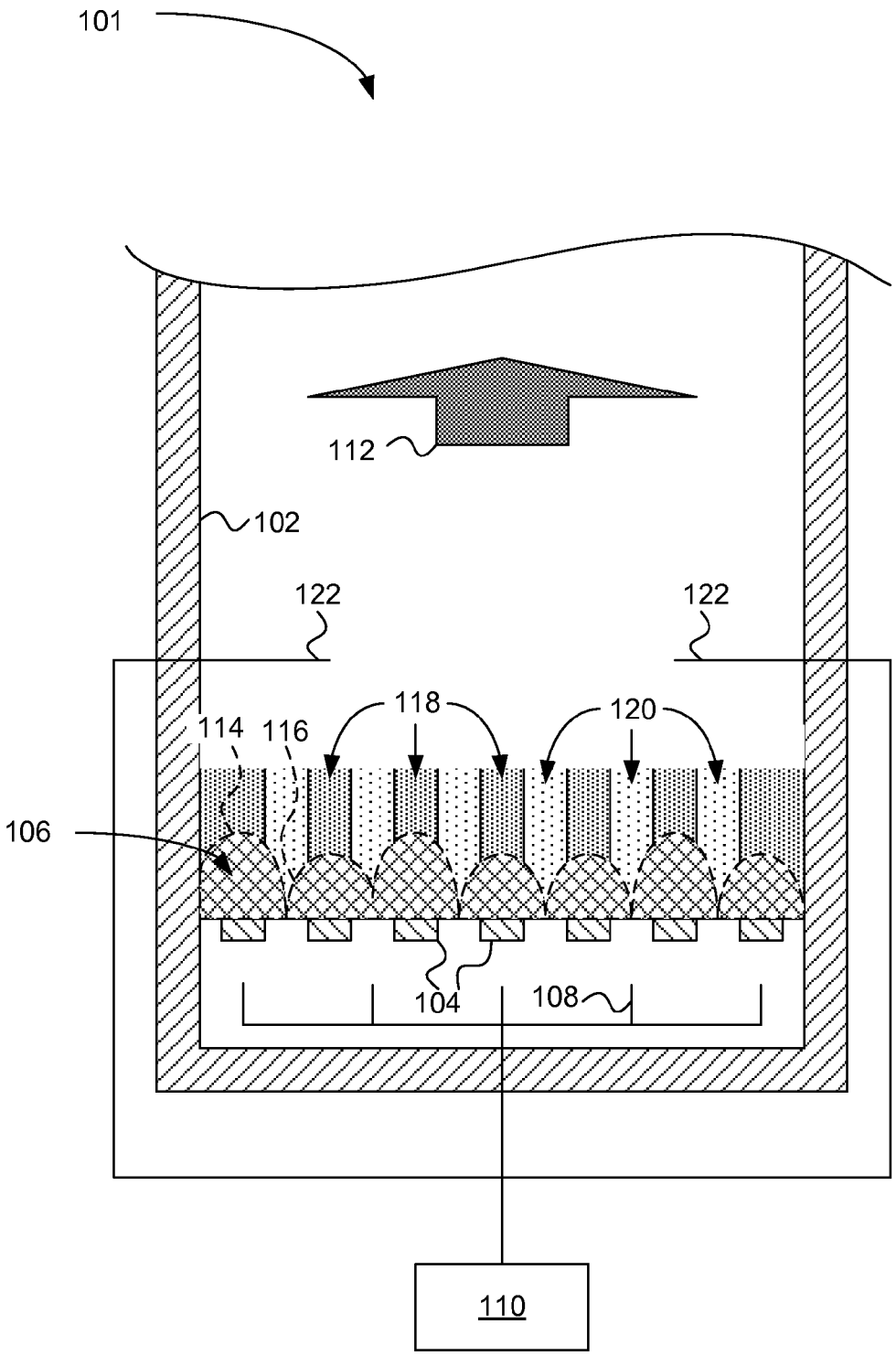
FIG. 1 is a diagram illustrating an aspect of a grate-fed solid fuel burner according to the prior art and which is improved according to the disclosure herein.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Figure 2:
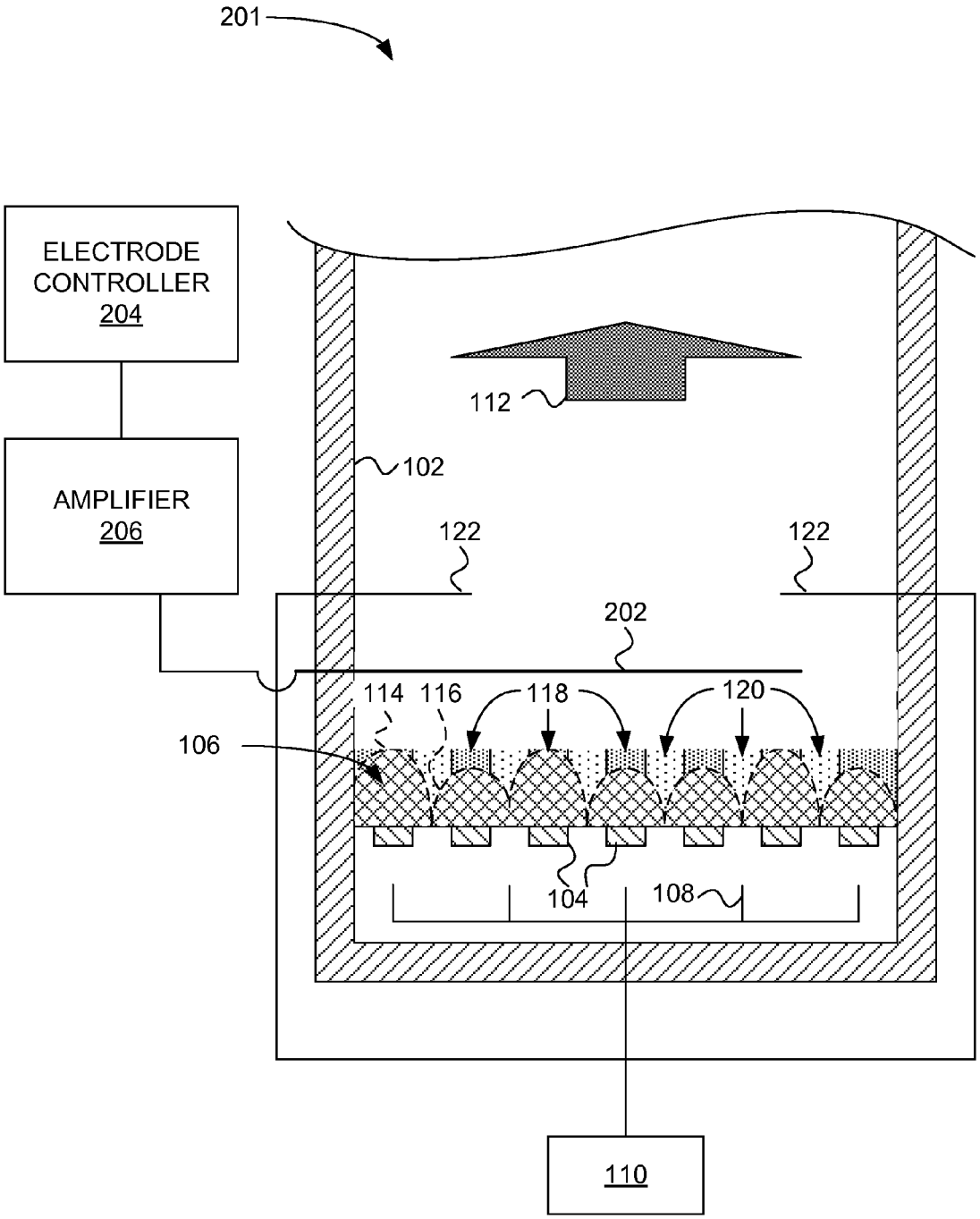
FIG. 2 is a diagram of a solid fuel burner configured for electrodynamic homogenization, according to an embodiment.

FIG. 2 is a diagram of a solid fuel burner 201 configured for electrodynamic homogenization, according to an embodiment. The solid fuel burner 201 may include a grate 104 configured to support a burning solid fuel 106. An underfire air source 108 may be configured to deliver underfire air to the burning solid fuel 106 from below the grate 104. One may alternatively refer to the underfire air source 108 as a primary air source or an undergrate air source. A system for providing electrodynamic homogenization may include an electrode 202 configured to apply an electric field to the burning solid fuel 106 or a region 118, 120 proximate the burning solid fuel 106. The electric field may be selected to cause mixing and homogenization of volatilized fractions of the solid fuel, combustion gases, and air.

Figure 3:
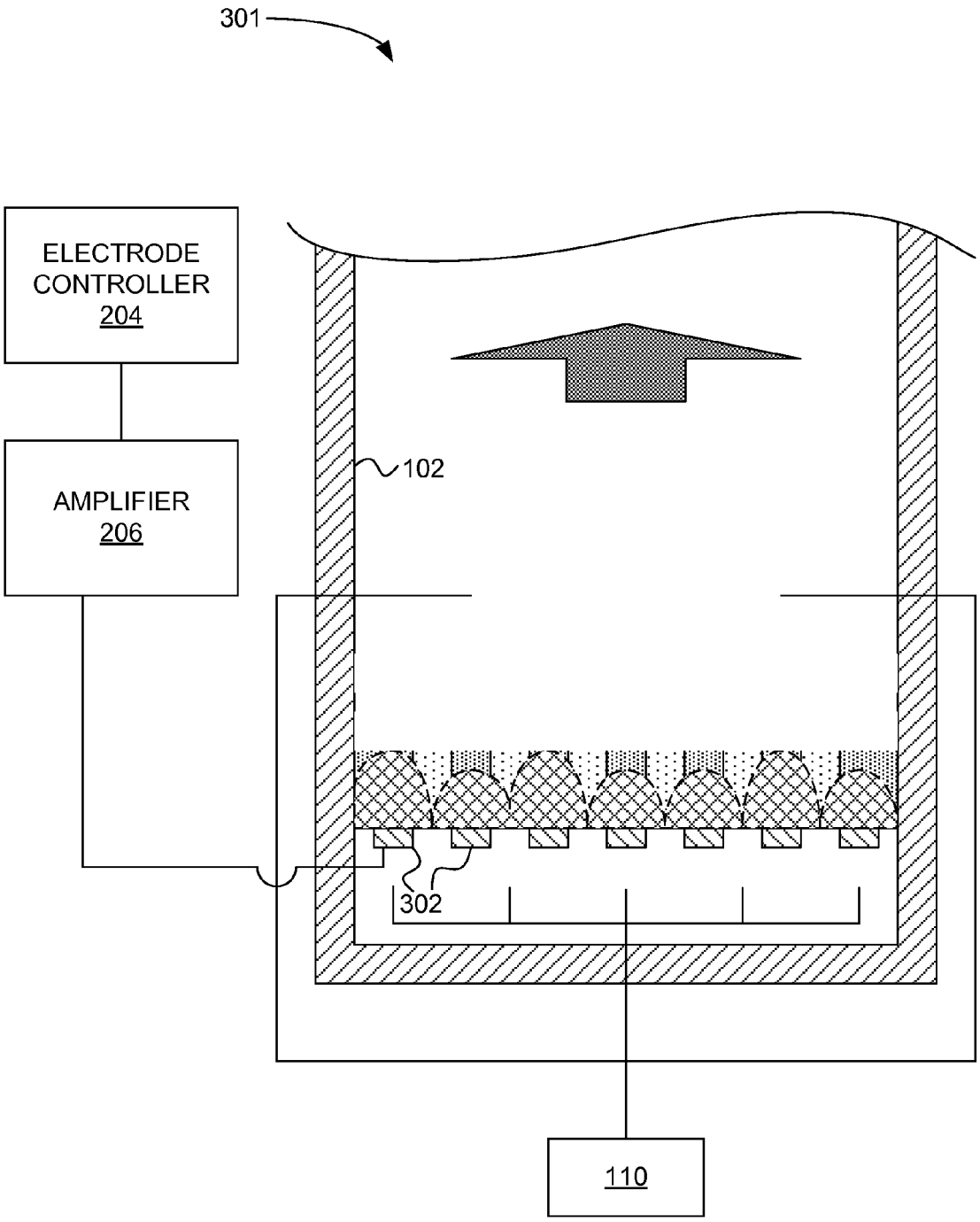
FIG. 3 is a diagram of a solid fuel burner configured for electrodynamic homogenization, according to another embodiment.
Figure 4:
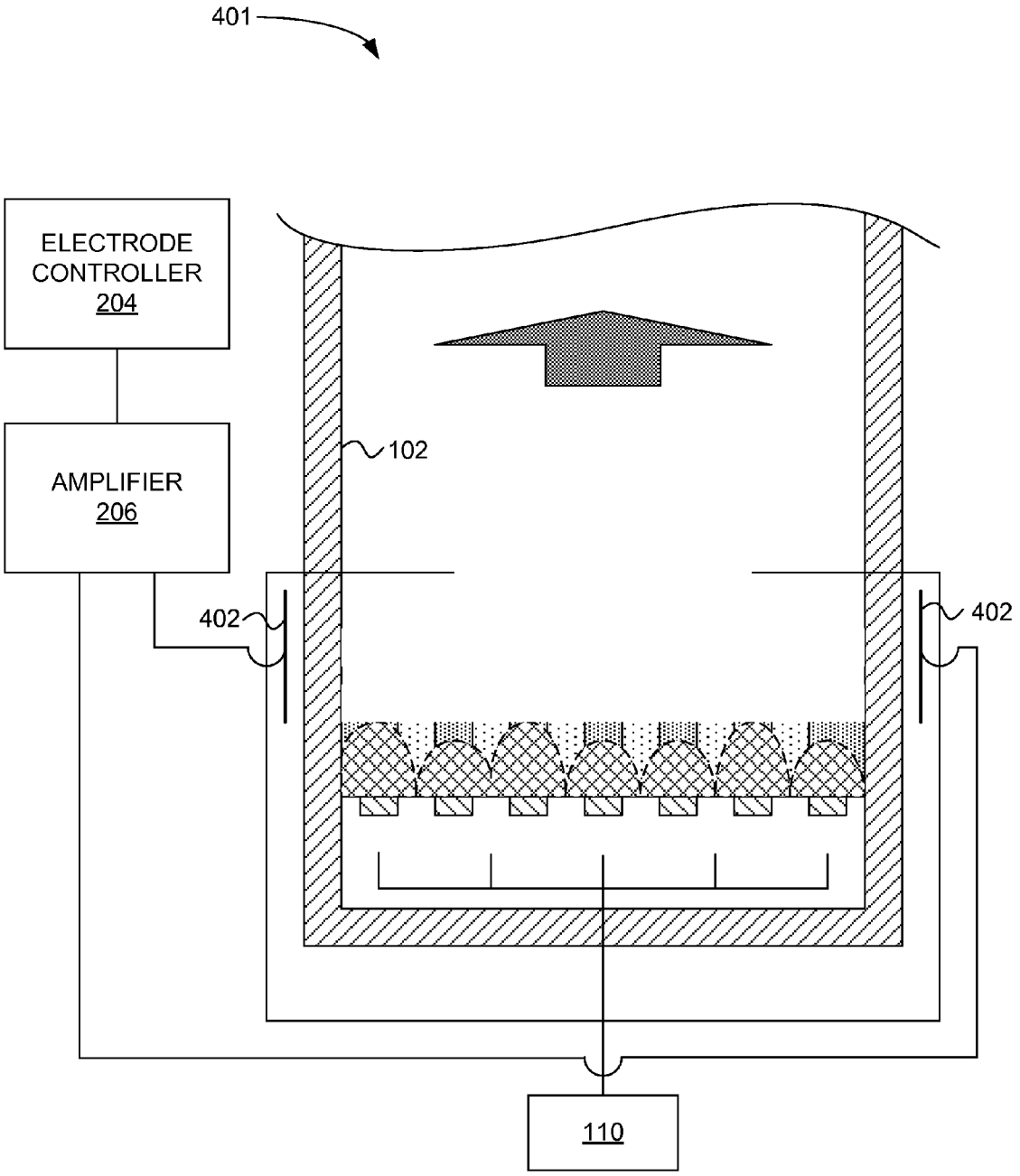
FIG. 4 is a diagram of a solid fuel burner configured for electrodynamic homogenization, according to another embodiment.

Various electrode embodiments are contemplated. As illustrated in the embodiment 201, the electrode 202 may be disposed above the grate 104 and the solid fuel 106. FIG. 3 is a diagram of a solid fuel burner 301 configured for electrodynamic homogenization according to another embodiment wherein the electrode 302 includes the grate 104. As may be appreciated by inspection of FIGS. 2 and 3, the solid fuel burner may include a wall 102 defining a combustion volume. The electrode 202, 302 may be disposed inside the combustion volume. Alternatively, the electrode may be disposed outside the combustion volume. FIG. 4 is a diagram of a solid fuel burner 401 according to another embodiment where the electrode 402 is disposed outside the combustion volume.

The electrode 202, 302, 402 may include a plurality of electrodes. Such a plurality may include plural electrodes 202 located in the combustion volume, plural grate electrodes 302 located in the combustion volume and/or plural electrodes 402 located outside the combustion volume. Plural electrodes may also include combinations of two or more of the electrodes 202, 302, 402 indicated diagrammatically in FIGS. 2-4. It will be understood (unless expressly indicated otherwise) that references to "an electrode" herein shall refer to any combination of single or plural electrodes indicated in the embodiments 201, 301, 401.

Referring to FIGS. 2-4 and the embodiments 201, 301, 401, homogenization may increase uniformity in oxygen and combustion reactant concentrations above the grate 104. As described above, concentration differences without the electrodynamic homogenization may include a more oxidizing atmosphere 120 above regions of the grate 104 carrying a small solid fuel 106 pile depth 116, and a more reducing atmosphere 118 above regions of the grate 104 carrying a large solid fuel 106 pile depth 114.

The solid fuel burner 201, 301, 401 may include an overfire air source 122 configured to deliver overfire air above the grate 104. Application of the electric field by the electrode 202, 302, 402 may result in a reduction in the amount of overfire air required to meet emission requirements compared to a system not including the electrode 202, 302, 402 and/or not providing electrodynamic homogenization. Application of the electric field by the electrode 202, 302, 402 may result in a reduction in an amount of underfire or undergrate air required to meet emission requirements compared to a system not including the electrode 202, 302, 402 and/or not providing electrodynamic homogenization. Similarly, application of the electric field by the electrode 202, 302, 402 may result in a reduction in the amount of total air required to meet emission requirements compared to a system not including the electrode 202, 302, 402 and/or not providing electrodynamic homogenization. Finally, the application of the electric field by the electrode 202, 302, 402 may result in a reduction in an emission of one or more of oxides of nitrogen (NOx) and carbon monoxide (CO) from the solid fuel 106 burning compared to a system not including the electrode 202, 302, 402 and/or not providing electrodynamic homogenization.

According to embodiments, the application of the electric field by the electrode 202, 302, 402 may result in heat release nearer the solid fuel 106 compared to a system not including the electrode 202, 302, 402 and/or not providing electrodynamic homogenization. The release of heat nearer the solid fuel 106 may provide enhanced drying of the solid fuel 106. This may allow the use of lower grade fuels, reduced preprocessing of fuel, and/or may allow the use of fuels that cannot normally be fired without application of heat from a second combustion reaction (e.g., co-firing with natural gas).

The solid fuel burner 201, 301, 401 may include an electrode controller 204 operatively coupled to the electrode(s) 202, 302, 402 and configured to determine an electrode 202, 302, 402 voltage or charge concentration corresponding to the electric field. The electrode controller 204 may include one or more of a state machine, a field-programmable gate array, a microcontroller, or discrete components configured to determine the electric field.

The solid fuel burner 201, 301, 401 may include an amplifier or voltage multiplier 206 operatively coupled to the electrode controller 204 and the electrode(s) 202, 302, 402, or included in the electrode controller 204 and operatively coupled to the electrode(s) 202, 302, 402. The amplifier or voltage multiplier 206 may be configured to output an operating voltage waveform to the electrode(s) 202, 302, 402 responsive to a logic level digital or low voltage analog signal received from the electrode controller 204.

According to embodiments, the electric field may include a time-varying electric field and the voltage may similarly correspond to a time-varying voltage applied to the electrode(s). For example, the time-varying electric field may include an electric field that varies according to an alternating current (AC) voltage waveform applied to the electrode(s). The time-varying voltage may include a sinusoidal, square wave, sawtooth wave, triangular wave, truncated triangular wave, logarithmic, or exponential waveform. Various voltages may be used. For example, the time-varying voltage applied to the electrode(s) may include a periodic voltage having an amplitude of 4000 to 115,000 volts (or ±4000 to 115,000 volts). The time-varying voltage may include a periodic voltage having a frequency of 50 to 800 Hertz, for example. According to some embodiments, the time-varying voltage can have a periodic frequency of 200 Hertz to 300 Hertz.

According to embodiments, the solid fuel burner 201, 301, 401 may include one or more sensors (not shown) operatively coupled to the electrode controller 204 and configured to measure one or more characteristics of the burning of the solid fuel 106, the flame, or combustion gas produced by the burning solid fuel 106. For example, the one or more sensors (not shown) may be configured to measure a variable characteristic of a completeness of combustion or a fuel 106 characteristic. The electrode controller 204 may be configured to select an electric field characteristic to increase gas mixing when the completeness of combustion is lower than a target value or when the fuel 106 characteristic corresponds to a need to increase mixing.

The solid fuel burner 201 (and variants 301, 401) may include a mechanical or pneumatic stoker (not shown) configured to deliver the solid fuel 106 to the grate 104 assembly.

The electrode controller 204 may be configured to control one or more of an overfire air 122 flow, the underfire air 108 flow, or a rate of fuel delivered by a stoker. Alternatively or additionally, the solid fuel burner 201, 301, 401 may include one or more of an overfire air controller (not shown), an underfire air controller (not shown), or a stoker controller (not shown) operatively coupled to the electrode controller 204.

The solid fuel burner 201, 301, 401 may include a physical gap (not shown) between a stoker (not shown) and the solid fuel 106 on the grate 104, the gap being configured to reduce or eliminate current leakage from the electric field through fuel carried by the stoker (not shown). Optionally, the solid fuel burner 201, 301, 401 may include a fuel cache (not shown) operatively coupled to a fuel stoker (not shown) and electrical insulation (not shown) between the fuel cache (not shown) and a support structure (not shown) The fuel cache (not shown) and the electrical insulation (not shown) may be configured to reduce or eliminate current leakage from the electric field through the stoker (not shown) and fuel positioned near a stoker intake (not shown).

Burning of various types of solid fuels are contemplated to benefit from electrodynamic homogenization. For example, the solid fuel 106 may include at least one of a biomass fuel, coal, a tire-derived fuel (TDF), municipal solid waste (MSW), refuse derived fuel (RDF), or a hazardous solid waste.

Figure 5:
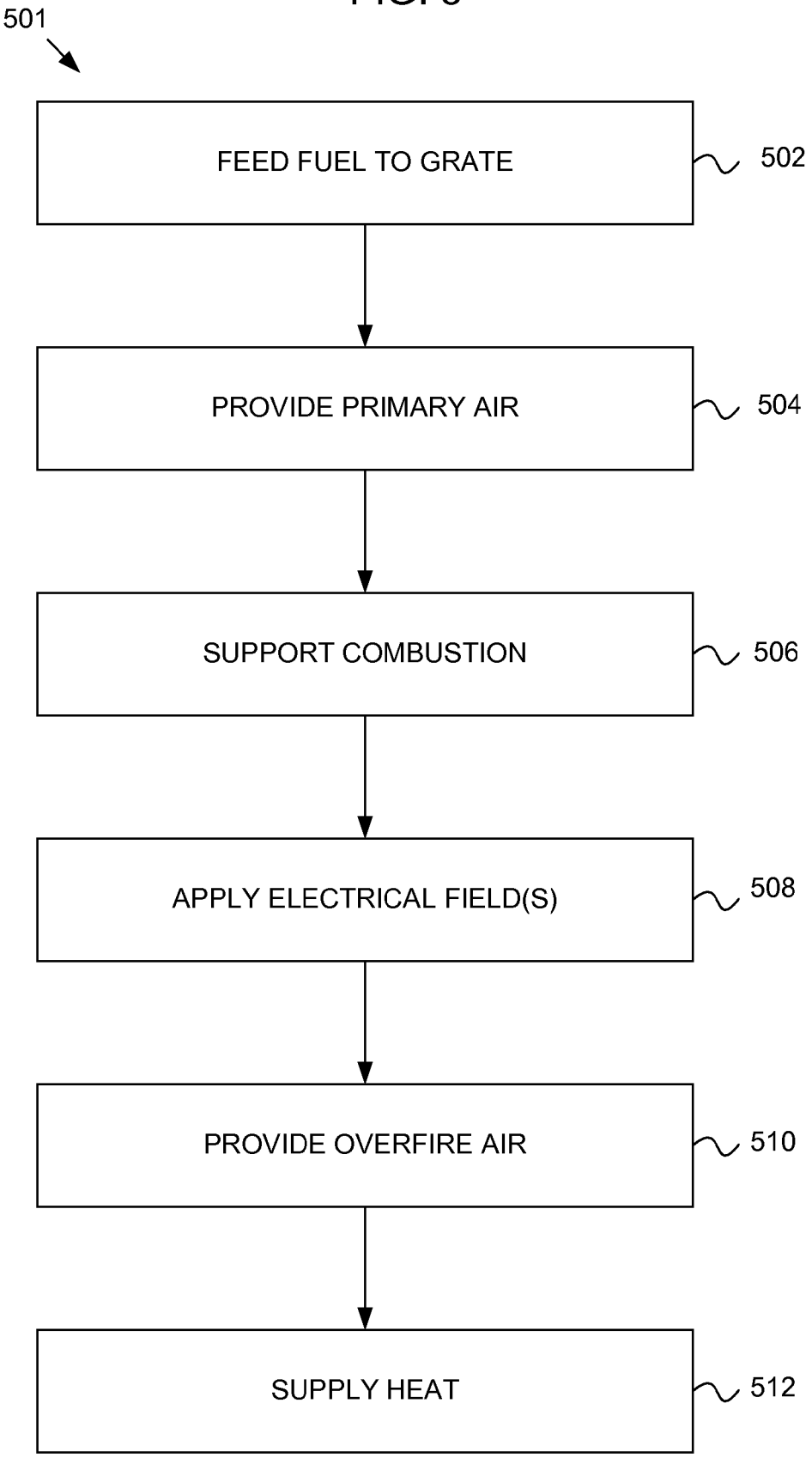
FIG. 5 is a flow chart showing a method for operating a solid fuel burner with electrodynamic homogenization, according to an embodiment.

FIG. 5 is a flow chart depicting a method 501 for operating a solid fuel burner with electrodynamic homogenization of the combustion reaction. In step 502 solid fuel may be delivered to a grate. For example, the solid fuel may be delivered to the grate with a mechanical or pneumatic stoker.

Proceeding to step 504, underfire combustion air may be fed from below the grate. In step 506, solid fuel on the grate may be burned with at least the underfire combustion air in a combustion reaction. Burning the solid fuel may include burning the solid fuel in a combustion volume defined by a wall.

Proceeding to step 508, a mixture of volatilized solid fuel and underfire combustion air above the fuel is homogenized by applying an electric field with at least one electrode. Various electrode arrangements are contemplated. For example, applying the electric field with at least one electrode may include applying an electric field with at least one electrode disposed inside the combustion volume. For example, the at least one electrode may be disposed above the grate. Alternatively or additionally, the at least one electrode may include the grate. According to embodiments, applying the electric field with at least one electrode may include applying the electric field with at least one electrode disposed outside the combustion volume. The at least one electrode may include a single electrode, or may include a plurality of electrodes. The plurality of electrodes may include a plurality of electrodes disposed similarly, for example, all electrodes being above the grate, all electrodes including portions of the grate, or all electrodes being disposed outside the combustion volume. Alternatively, a plurality of electrodes may include one or more electrodes above the grate, one or more electrodes comprising the grate, and/or one or more electrodes disposed outside the combustion volume.

Step 508 may include operating an electrode controller to determine the electric field. In some embodiments, the electric field may be a DC electric field or an intermittently applied DC electric field. Alternatively, the electric field may include a time-varying electric field. Operating the electrode controller may include amplifying a logic level digital or low voltage analog signal received from the electrode controller to an operating voltage placed on the at least one electrode. Additionally or alternatively, operating the electrode controller may include one or more of operating a state machine, operating a field-programmable gate array, operating a microcontroller, or operating discrete components configured to determine (optionally time-varying) electric field.

A time-varying electric field may include an electric field that varies according to an alternating current (AC) voltage waveform applied to the electrode(s). The time-varying electric field may include a sinusoidal, square wave, sawtooth wave, triangular wave, truncated triangular wave, logarithmic, or exponential waveform.

Applying a time-varying voltage to the electrode to produce a time-varying electric field in step 508 may include applying a periodic voltage having an amplitude of 4000 to 115,000 volts. Applying a time-varying voltage to the electrode to produce a time-varying electric field may include applying a time-varying periodic voltage having a frequency of 50 to 800 Hertz. According to some embodiments, the time-varying voltage can have a periodic frequency of 200 Hertz to 300 Hertz.

Optionally, the method 501 may include operating one or more sensors operatively coupled to the electrode controller to measure one or more characteristics of the combustion reaction. For example, operating one or more sensors may include measuring a variable characteristic of a completeness of combustion. Operating the electrode controller in step 508 may include selecting the electric field to increase the homogenization when the completeness of combustion is lower than a target value.

The electrodynamic homogenization may increase uniformity in oxygen concentration above the grate. The differences may be caused by solid fuel pile depth variations across the grate, the differences include a more oxidizing atmosphere above regions of the grate carrying a small solid fuel pile depth and a more reducing atmosphere above regions of the grate carrying a large solid fuel pile depth.

The application of the electric field by the electrode in step 508 may further increase the release of heat near the fuel. This may be used to dry wet fuel, pre-heat difficult-to-burn fuel, or otherwise improve fuel flexibility.

Proceeding to step 510, overfire or secondary air may be applied over the burning fuel on the grate. For example, this may include operating an overfire air source. Operating the overfire air source may include delivering sufficient overfire air to substantially complete combustion of the solid fuel. The application of the electric field by the electrode may results in a reduction in the amount of overfire air required to meet emission requirements compared to a system not including the electrode. Additionally or alternatively, the electrodynamic homogenization provided by the application of the electric field by the electrode may result in a reduction in an amount of underfire air required to meet emission requirements compared to a system not including the electrode. Moreover, the application of the electric field by the electrode may results in a reduction in an amount of total air required to meet emission requirements compared to a system not including the electrode.

The application of the electric field by the electrode may result in a reduction in an emission of one or more of oxides of nitrogen (NOx) and carbon monoxide (CO) from the solid fuel burning compared to a system not including the electrode to apply the electric field.

The method 501 may optionally include controlling one or more of an overfire air flow, the underfire air flow, or a rate of fuel delivered by the stoker. Additionally or alternatively, the method 501 may include communicating, from an electrode controller, with one or more of an overfire air controller, an underfire air controller or a stoker controller.

The solid fuel may include a biomass fuel, coal, tire-derived fuel (TDF), or other solid fuel. As mentioned above, fuel flexibility may be improved by the electrodynamic homogenization.

In cases where the solid fuel is delivered to the grate with a stoker, current leakage from the electric field through the solid fuel may be reduced or eliminated by maintaining an air gap between the stoker and the solid fuel on the grate. Additionally or alternatively, current leakage from the electric field through the fuel may be reduced or eliminated by delivering electrically isolated fuel to a fuel cache, maintaining electrical insulation between the fuel cache and a support structure and between the stoker and the support structure. The stoker may deliver the solid fuel from the electrically isolated fuel cache.

Proceeding to step 512, heat from the combustion may be supplied. For example, the heat may be supplied to an electrical generation system, a chemical process, or to provide domestic heating.

The method for operating a solid fuel burner 301 may include operating one or more sensors operatively coupled to an electrode controller to measure one or more characteristics of the combustion reaction. Operating one or more sensors may include measuring a variable characteristic of a completeness of combustion. Operating the electrode controller may include selecting the time-varying electric field to increase the homogenization when the completeness of combustion is lower than a target value. At least one sensor (not shown) may be disposed to sense a condition proximate the burning fuel or a combustion gas above the burning fuel. The first sensor may be operatively coupled to the electrode controller via a sensor signal transmission path (not shown). The at least one sensor (not shown) may be configured to sense a combustion parameter of the burning fuel or the combustion gas above the burning fuel. For example the at least one sensor may include one or more of a flame luminance sensor, a photo-sensor, an infrared sensor, a fuel flow sensor, a temperature sensor, a flue gas temperature sensor, a radio frequency sensor, and/or an airflow sensor.

Figure 6:
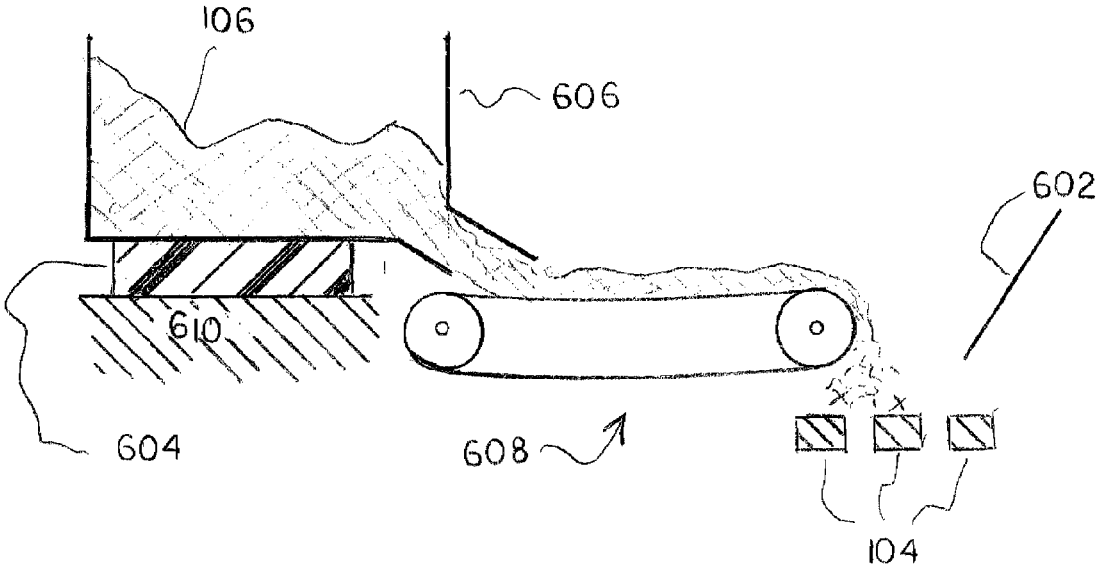
FIG. 6 is a schematic view of a fuel feed mechanism, according to an embodiment.

FIG. 6, a non-limiting schematic view, shows a fuel cache 606, from which fuel 106 passes to a stoker 608 and thence to grate 104. Electrical insulation 604 is disposed between the fuel cache 606 and a support structure 610 (a structure, not naturally occurring, that supports the fuel cache 606; insulation may also be comprised in or constitute the support structure 610, or an additional support structure). An electric field from an electrode 602 is applied to the fuel 106. The insulation prevents or reduces electrical current leakage.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A solid fuel burner with electrodynamic homogenization, comprising:

a grate configured to support a burning solid fuel;

an underfire air source configured to deliver underfire air to the burning solid fuel from below the grate;

an electrode configured to apply an electric field to the burning solid fuel or a region proximate the burning solid fuel; a fuel cache operatively coupled to a fuel stoker; and electrical insulation between the fuel cache and a support structure; wherein the fuel cache and the electrical insulation are configured to reduce or eliminate current leakage from the electric field through the fuel stoker and fuel positioned near a fuel stoker intake; and wherein the electric field is selected to cause mixing and homogenization of volatilized fractions of the solid fuel, combustion gases, and air.

2. The solid fuel burner with electrodynamic homogenization of claim 1, wherein the fuel stoker comprises:

a mechanical or pneumatic stoker configured to deliver the solid fuel to the grate.

3. The solid fuel burner with electrodynamic homogenization of claim 1, wherein the electrode is disposed above the grate and the solid fuel.

4. The solid fuel burner with electrodynamic homogenization of claim 1, wherein the electrode includes the grate.

5. The solid fuel burner with electrodynamic homogenization of claim 1, wherein the homogenization increases uniformity in oxygen and combustion reactant concentrations above the grate.

6. The solid fuel burner with electrodynamic homogenization of claim 1, further comprising:

an overfire air source configured to deliver overfire air above the grate.

7. The solid fuel burner with electrodynamic homogenization of claim 6, wherein the application of the electric field by the electrode results in a reduction in the amount of overfire air required to meet emission requirements compared to a system not including the electrode.

8. The solid fuel burner with electrodynamic homogenization of claim 6, wherein the application of the electric field by the electrode results in a reduction in an amount of underfire air required to meet emission requirements compared to a system not including the electrode.

9. The solid fuel burner with electrodynamic homogenization of claim 6, wherein the application of the electric field by the electrode results in a reduction in the amount of total air required to meet emission requirements compared to a system not including the electrode.

10. The solid fuel burner with electrodynamic homogenization of claim 1, wherein the application of the electric field by the electrode results in a reduction in an emission of one or more of oxides of nitrogen (NOx) and carbon monoxide (CO) from the solid fuel burning compared to a system not including the electrode.

11. The solid fuel burner with electrodynamic homogenization of claim 1, wherein the application of the electric field by the electrode results in heat release nearer the solid fuel and drying of the solid fuel compared to a system not including the electrode.

12. The solid fuel burner with electrodynamic homogenization of claim 1, further comprising:

a wall defining a combustion volume;

wherein the electrode is disposed inside the combustion volume.

13. The solid fuel burner with electrodynamic homogenization of claim 1, further comprising:

a wall defining a combustion volume;

wherein the electrode is disposed outside the combustion volume.

14. The solid fuel burner with electrodynamic homogenization of claim 1, wherein the electrode includes a plurality of electrodes.

15. The solid fuel burner with electrodynamic homogenization of claim 1, further comprising:

an electrode controller operatively coupled to the electrode and configured to determine an electrode voltage or charge concentration corresponding to the electric field.

16. The solid fuel burner with electrodynamic homogenization of claim 15, wherein the electric field includes a time-varying electric field and the voltage corresponds to a time-varying voltage.

17. The solid fuel burner with electrodynamic homogenization of claim 16, wherein the time-varying electric field includes an electric field that varies according to an alternating current (AC) voltage waveform applied to the electrode.

18. The solid fuel burner with electrodynamic homogenization of claim 16, wherein the time-varying voltage includes a sinusoidal, square wave, sawtooth wave, triangular wave, truncated triangular wave, logarithmic, or exponential waveform.

19. The solid fuel burner with electrodynamic homogenization of claim 16, wherein the time-varying voltage includes a periodic voltage having an amplitude of 4000 to 115,000 volts.

20. The solid fuel burner with electrodynamic homogenization of claim 16, wherein the time-varying voltage includes a periodic voltage having a frequency of 50 to 800 Hertz.

21. The solid fuel burner with electrodynamic homogenization of claim 16, further comprising:

an amplifier or voltage multiplier operatively coupled to the electrode controller and the electrode, or included in the electrode controller and operatively coupled to the electrode;

wherein the amplifier or voltage multiplier is configured to output an operating voltage waveform to the electrode responsive to a logic level digital or analog signal received from the electrode controller.

22. The solid fuel burner with electrodynamic homogenization of claim 16, wherein the electrode controller includes one or more of a state machine, a field-programmable gate array, a microcontroller, or discrete components configured to determine the time-varying electric field.

23. The solid fuel burner with electrodynamic homogenization of claim 15, further comprising:

one or more sensors operatively coupled to the electrode controller and configured to measure one or more characteristics of the burning of the solid fuel, the flame, or combustion gas produced by the burning solid fuel.

24. The solid fuel burner with electrodynamic homogenization of claim 23, wherein the one or more sensors are configured to measure a variable characteristic of a completeness of combustion or a fuel characteristic; and wherein the electrode controller is configured to select an electric field characteristic to increase gas mixing when the completeness of combustion is lower than a target value or when the fuel characteristic corresponds to a need to increase mixing.

25. The solid fuel burner with electrodynamic homogenization of claim 15, wherein the electrode controller is further configured to control one or more of an overfire air flow, the underfire air flow, or a rate of fuel delivered by the fuel stoker.

26. The solid fuel burner with electrodynamic homogenization of claim 15, further comprising:

one or more of an overfire air controller, an underfire air controller or the fuel stoker controller operatively coupled to the electrode controller.

27. The solid fuel burner with electrodynamic homogenization of claim 1, wherein the solid fuel includes at least one of a biomass fuel, coal, a tire-derived fuel (TDF), municipal solid waste (MSW), refuse derived fuel (RDF), or a hazardous solid waste.

28. The solid fuel burner with electrodynamic homogenization of claim 1, further comprising a physical gap between the fuel stoker and the solid fuel on the grate, the gap being configured to reduce or eliminate current leakage from the electric field through fuel carried by the stoker.

29. A method for operating a solid fuel burner, comprising:

delivering underfire combustion air below a grate;

burning a solid fuel on the grate with the combustion air in a combustion reaction;

homogenizing a mixture of volatilized solid fuel and underfire combustion air in the combustion reaction by applying an electric field with at least one electrode; delivering the solid fuel to the grate with a stoker; and reducing or eliminating current leakage from the electric field through the fuel by: delivering electrically isolated fuel to a fuel cache; and maintaining electrical insulation between the fuel cache and a support structure and between the stoker and the support structure; wherein delivering solid fuel to the grate with the stoker includes delivering solid fuel from the fuel cache.

30. The method for operating a solid fuel burner of claim 29, wherein the homogenization increases uniformity in oxygen concentration above the grate.

31. The method for operating a solid fuel burner of claim 30, wherein the differences are caused by solid fuel pile depth variations across the grate.

32. The method for operating a solid fuel burner of claim 31, wherein the differences include a more oxidizing atmosphere above regions of the grate carrying a small solid fuel pile depth and a more reducing atmosphere above regions of the grate carrying a large solid fuel pile depth.

33. The method for operating a solid fuel burner of claim 29, further comprising:

operating an overfire air source to deliver overfire air above the grate.

34. The method for operating a solid fuel burner of claim 33, wherein operating the overfire air source includes delivering sufficient overfire air to substantially complete combustion of the solid fuel.

35. The method for operating a solid fuel burner of claim 34, wherein the application of the electric field by the electrode results in a reduction in the amount of overfire air required to meet emission requirements compared to a system not including the electrode.

36. The method for operating a solid fuel burner of claim 29, wherein the application of the electric field by the electrode results in a reduction in an amount of undergrate air required to meet emission requirements compared to a system not including the electrode.

37. The method for operating a solid fuel burner of claim 29 wherein the application of the electric field by the electrode results in a reduction in an amount of total air required to meet emission requirements compared to a system not including the electrode.

38. The method for operating a solid fuel burner of claim 29, wherein the application of the electric field by the electrode results in a reduction in an emission of one or more of oxides of nitrogen (NOx) and carbon monoxide (CO) from the solid fuel burning compared to a system not including the electrode.

39. The method for operating a solid fuel burner of claim 29, wherein burning the solid fuel includes burning the solid fuel in a combustion volume defined by a wall.

40. The method for operating a solid fuel burner of claim 39, wherein applying the electric field with at least one electrode includes applying an electric field with at least one electrode disposed inside the combustion volume.

41. The method for operating a solid fuel burner of claim 39, wherein applying the electric field with at least one electrode includes applying the electric field with at least one electrode disposed outside the combustion volume.

42. The method for operating a solid fuel burner of claim 29, wherein the at least one electrode includes a plurality of electrodes.

43. The method for operating a solid fuel burner of claim 29, further comprising:

operating an electrode controller to determine the electric field.

44. The method for operating a solid fuel burner of claim 43, wherein the electric field includes a time-varying electric field.

45. The method for operating a solid fuel burner of claim 44, further comprising:

amplifying a logic level digital or analog signal received from the electrode controller to an operating voltage placed on the at least one electrode.

46. The method for operating a solid fuel burner of claim 44, wherein operating the electrode controller includes one or more of operating a state machine, operating a field-programmable gate array, operating a microcontroller, or operating discrete components configured to determine the time-varying electric field.

47. The method for operating a solid fuel burner of claim 44, further comprising:

operating one or more sensors operatively coupled to the electrode controller to measure one or more characteristics of the combustion reaction.

48. The method for operating a solid fuel burner of claim 47, wherein operating one or more sensors includes measuring a variable characteristic of a completeness of combustion; and wherein operating the electrode controller includes selecting the time-varying electric field to increase the homogenization when the completeness of combustion is lower than a target value.

49. The method for operating a solid fuel burner of claim 44, wherein the time-varying electric field includes an electric field that varies according to an alternating current (AC) voltage waveform applied to the electrode.

50. The method for operating a solid fuel burner of claim 44, wherein the time-varying electric field includes a sinusoidal, square wave, sawtooth wave, triangular wave, truncated triangular wave, logarithmic, or exponential waveform.

51. The method for operating a solid fuel burner of claim 44, further comprising:

applying a time-varying voltage to the electrode to produce the time-varying electric field, the time-varying voltage including a periodic voltage having an amplitude of 4000 to 115,000 volts.

52. The method for operating a solid fuel burner of claim 44, further comprising:

applying a time-varying voltage to the electrode to produce the time-varying electric field, the time-varying voltage including a periodic voltage having a frequency of 50 to 800 Hertz.

53. The method for operating a solid fuel burner of claim 29, further comprising:

controlling one or more of an overfire air flow, the underfire air flow, or a rate of fuel delivered by the stoker.

54. The method for operating a solid fuel burner of claim 43, further comprising:

communicating, with the electrode controller, with one or more of an overfire air controller, an underfire air controller or a stoker controller.

55. The method for operating a solid fuel burner of claim 29, wherein the solid fuel includes a biomass fuel.

56. The method for operating a solid fuel burner of claim 29, wherein the solid fuel includes coal.

57. The method for operating a solid fuel burner of claim 29, wherein the solid fuel includes a tire-derived fuel (TDF).

58. The method for operating a solid fuel burner of claim 29, further comprising:

delivering the solid fuel to the grate with a stoker; and reducing or eliminating current leakage from the electric field through the solid fuel by maintaining an air gap between the stoker and the solid fuel on the grate.

* * * * *